United States Patent [19]

Cipriano

[11] Patent Number: 4,566,956

[45] Date of Patent: Jan. 28, 1986

[54] ELECTROCHEMICAL CONVERSION OF SOLUBLE SALTS OF INSOLUBLE ACIDS TO THEIR ACID FORM

[75] Inventor: Robert A. Cipriano, Lake Jackson, Tex.

[73] Assignee: The Dow Chemical Company, Midland, Mich.

[21] Appl. No.: 679,503

[22] Filed: Dec. 7, 1984

[51] Int. Cl.[4] ..... C25B 3/00; B01D 57/02

[52] U.S. Cl. ..... 204/72; 204/101; 204/102; 204/128; 204/182.4

[58] Field of Search ..... 204/72, 180 P, 101, 204/102, 128

[56] References Cited

U.S. PATENT DOCUMENTS 2,921,005 1/1960 Bodamer ..... 204/72

3,766,038 10/1973 Beck ..... 204/180 P

*Primary Examiner*—John F. Niebling

*Attorney, Agent, or Firm*—G. R. Baker

[57] ABSTRACT

A process is disclosed for converting water soluble salts of insoluble organic acids to their insoluble acid form employing electrochemical techniques.

1 Claim, 1 Drawing Figure

FIGURE 1

ELECTROCHEMICAL CELL FOR MULTIPLE ION SUBSTITUTION

ELECTROCHEMICAL CELL FOR MULTIPLE ION SUBSTITUTION

ELECTROCHEMICAL CONVERSION OF SOLUBLE SALTS OF INSOLUBLE ACIDS TO THEIR ACID FORM

BACKGROUND OF THE INVENTION

This invention relates to the preparation of an insoluble carboxylic acid from the corresponding alkali metal carboxylate in an aqueous solution. In particular, the invention relates to the use of an electrochemical cell and a double decomposition reaction for the conversion of salts of carboxylic acids into the corresponding carboxylic acids.

The alkali metal carboxylates are usually prepared by the reaction of an amine with formaldehyde, cyanide, and an alkali metal hydroxide. See the U.S. Pat. Nos. 2,387,735 2,407,645 and 2,885,428, which later patent not only described the producton of ethylenediaminetetraacetic acid (EDTA), but typifies the chemistry presently used to isolate the acid product. In said patent, hydrolysis to the free acid is accomplished by reacting the nitrile with a strong mineral acid such as hydrochloric or sulfuric. This results in either the formation of 2 moles of $(NH_4)_2SO_4$ or 4 moles of $NH_4Cl$ per mole of EDTA, depending on which acid is used. U.S. Pat. No. 2,407,645 teaches that the presence of alkali metal hydroxide has the advantage of aiding the rapid and complete hydrolysis of the nitrile formed. The presence of alkali metal hydroxide results in the production of an aqueous solution of the sodium salt of ethylenediaminetetraacetic acid. On acidifying to a pH between 0.75 and 2.0, the corresponding free acid precipitates with the simultaneous production of the corresponding inorganic salt. Therefore, in both examples cited, an acidification process is used to isolate the free acid with the simultaneous production of an organic laden inorganic salt stream.

The present invention performs the same isolation without the production of an undesirable inorganic waste stream. The present invention has the added benefit of simultaneously producing an alkali metal hydroxide stream.

An additional embodiment of this invention is the direct addition of ammonia, as a gas or as ammonium hydroxide, to the stream containing the carboxylic acid. $NH_3$ gas produced in the process may be added directly to the middle stream. The presence of $H_2$ in the catholyte gas stream has no deleterious effect on the process when that stream is used as an ammonia source. The $NH_3$ produced in the catholyte may also be added to the anolyte stream, or an outside ammonia source may be used.

BRIEF DESCRIPTION OF THE INVENTION

In accordance with the present invention a three compartment cell having an anolyte compartment, a catholyte compartment and a central compartment separated from each of the anolyte and catholyte compartments, respectively, by two cation membranes is operated to produce in the anolyte compartment a strong acid, in the middle compartment an ammonium salt form of the insoluble organic acid, and in the catholyte compartment a hydroxide of the cation of the soluble salt of the organic acid. The feeds to the three compartments are:

| Anolyte | Middle | Catholyte |
|---|---|---|
| $NH_4$ + form of strong inorganic acid | Alkali/alkaline earth metal salt of organic acid | water/alkali/alkaline earth metal hydroxides |

The product of the middle chamber may be reacted with the product of the anolyte to reform the starting anolyte and precipitate the organic acid.

The resulting $(NH_4)_2SO_4$ ammonium salt of the inorganic acids may be recycled to the anolyte chamber. The products of the catholyte chamber are separated to yield a hydrogen/ammonia stream and a hydroxide stream. During operation of the cell the $H_2/NH_3$ stream may be fed into the middle compartment in which case the middle compartment must have a $H_2$ off gas outlet. Alternatively, the $NH_3$ and $H_2$ may be separated and the ammonia fed into the anolyte chamber. The hydroxide may be used to form the soluble salt of the insoluble organic acid which is to be feed to the middle compartment.

Thus, there is seen to be a process which in its most preferred form requires only the addition of water and small make up quantities of ammonia. The sulfuric acid prepared in the cell is used to convert the soluble form of the insoluble organic acid being fed to its insoluble free acid form. Substantially no waste streams are produced and byproduct losses are minimized.

BRIEF DESCRIPTION OF THE INVENTION

In accordance with the present invention the electrolytic process for converting salts of organic acids to their corresponding free acids employs a cationic permselective membrane. The result of the employment of such membrane to separate the usual three compartments of such processes, ie. the anolyte compartment, the catholyte compartment and the intermediate compartment wherein the conversion occurs is a more energy efficient process wherein a higher concentration of catholyte is produced with fewer byproduct contamination of the respective compartments. In addition the employment of a major conversion cell in series with one or more finishing cells reduces the overall power requirements and improves the overall current efficiencies of the process.

Any of the several prior art cell designs may be employed but the three compartment cell is the preferred model. The cells of the present invention are preferably designed to have a very narrow intermediate cell, measured membrane to membrane, usually about 0.7 to 1.0 millimeter and conceivably less than 0.7 mm. The intermediate cell is placed under a positive pressure from each of the anolyte and catholyte chambers and the membranes are maintained spaced apart by a non-reactive, non-conductive porous separator, preferably a woven or non-woven laminar mesh like scrim of for example polyethylene or polypropylene.

Neither the materials of construction nor the design configuration of the electrodes are critical and may be any of the known reported prior art electrode materials suitably taught to be stable and useful for each of the anolyte and catholyte electrolytes.

A preferred anode material employed in the process is platinum on a titanium support. Other metals, e.g. lead, tin, silver, antimony, iridium, ruthenium, cobalt, platinum, or mixtures thereof are useful as anode materials either as is or coated on a support. Graphite may also be used. Less expensive materials may also be incorporated into the electrode to reduce cost, increase stability, and broaden the operating range. Cathode materials useful in the process are palladium, platinum, nickel, carbon, steel, titanium or mixtures thereof. All of the above can be used per se or coated on a suitable substrate, e.g. carbon, steel, or titanium.

Similarly the number of cells to make up a unit is not critical but should be of a number and size to accomodate the available power supply.

Preferably the units should be designed to produce 99+% conversion of the alkali/alkaline earth metal salt to the ammonium salt in the cells and the resulting ammonium salt reacted with a strong acid, for economy the anolyte acid, eg. sulfuric acid thereby forming the free organic acid and ammonium sulfate. The free acid compound separates as a solid and the mother liquor under the preferred mode of operation is used as feed to the anolyte chamber.

DETAILED DESCRIPTION OF THE DRAWING

Figure 1:
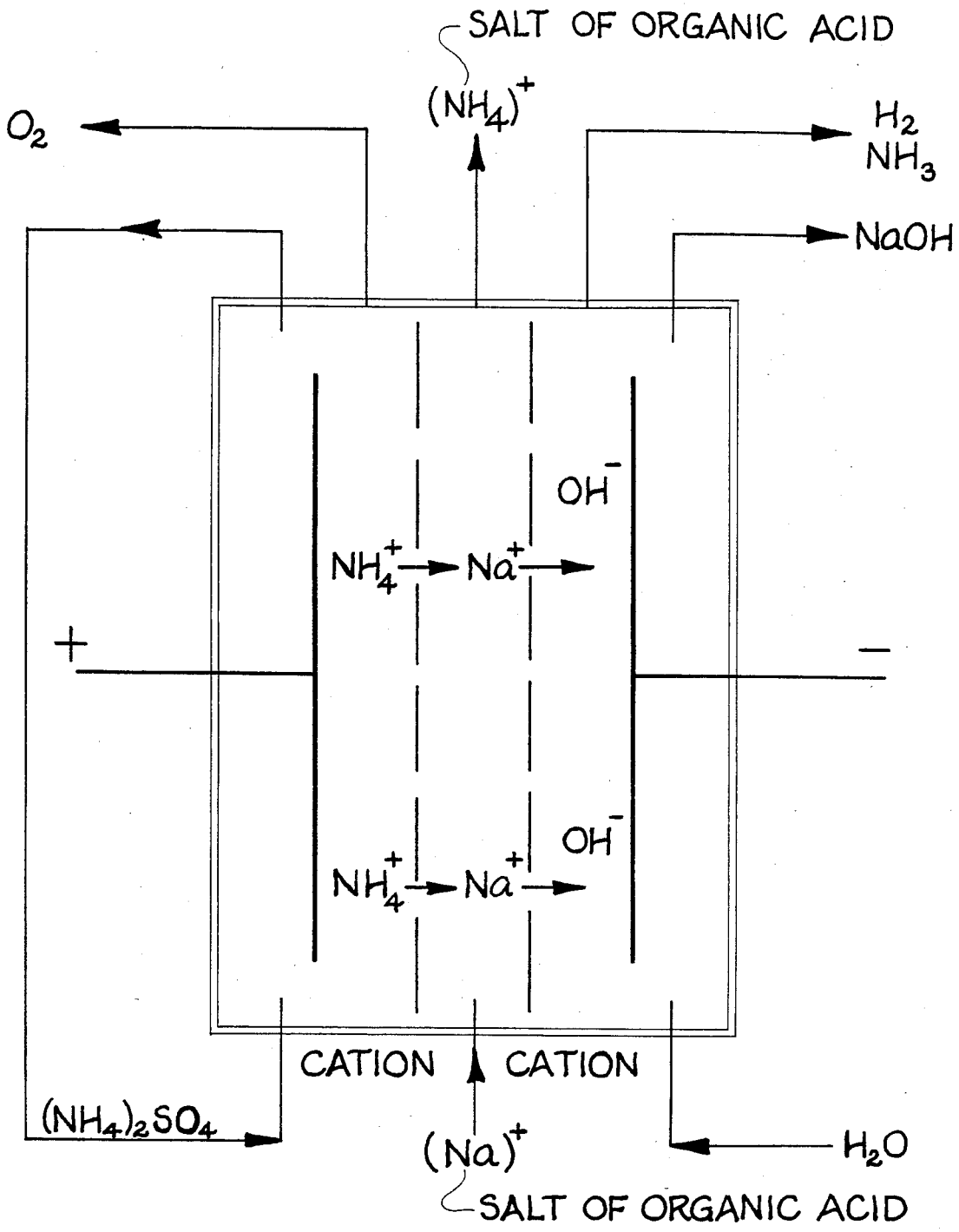

The present invention is idealized in the drawing:

FIG. 1 illustrates in side view an idealized cell design.

DETAILED DESCRIPTION OF THE INVENTION

A three compartment cell having the anolyte chamber and catholyte chamber separated from each other by a middle compartment defined by two cationic membranes is operated by feeding an anolyte comprised of the ammonium form of a strong acid, a middle stream of the soluble alkali metal or alkaline earth metal salt of insoluble organic acid to be produced.

The catholyte stream is comprised of alkali or alkaline earth metal cations transported from the middle compartment which necessarily combine with the hydroxyl ions being produced at the cathode. The cell converts the ammonium salt of the strong acid to its acid form releasing ammonium ion which passes through the membrane into the center or middle compartment. Therein the soluble salt of the insoluble organic acid is converted to the ammonium salt of the acid releasing sodium ions which pass through the catholyte membrane combining with the hydroxyl ions produced at the cathode, forming the alkali or alkaline earth metal hydroxide. The acid from the anolyte compartment is combined with the ammonium salt of the organic acid releasing the free organic acid and forming the feed for the anolyte chamber. The alkali/alkaline earth metal hydroxide formed in the catholyte chamber is used in the formation of soluble salt of the insoluble organic acid. The ammonia and hydrogen are added to the center compartment solution as recycle and/or to the anolyte, preferably the center compartment, since the $H_2$ can be released readily and the ammonia directly reacted with the acid moiety to form the ammonium salt.

EXAMPLE 1

The anolyte was comprised of 1,500 grams of 20.56 wt% $(NH_4)_2SO_4$ and was pumped through the anode chamber at 410 cc/min. The catholyte was comprised of 9.63 wt% NaOH and was pumped through the cathode chamber at 420 cc/min. The middle solution was comprised of 1,102 grams of 35 wt% ethylenediaminetetracetic acid tetrasodium salt ($EDTANa_4$), and was pumped through the middle compartment at 270 cc/min. The voltage of the cell was adjusted to yield a current density of 1.0 amps/in$^2$. Table I gives the parameters measured during the run.

The pH, measured as a 10 volume percent solution of the process stream in deionized water, was 6.28. Ninety nine percent of the $EDTANa_4$ charged was recovered as EDTA. Sodium hydroxide (1,936.5 grams of 13.68 wt%) was recovered as the final catholyte.

EXAMPLE 2

The anolyte was comprised of 1,818 grams of Versene mother liquor from Example 1, adjusted to pH 5.51 with $NH_4OH$. The flow rate through the anode chamber was 540 cc/min. The middle solution was comprised of 1102.4 grams of 35 wt% $EDTANa_4$ and was pumped through the middle compartment at 250 cc/min. The voltage of the cell was adjusted to yield a current density of 1.0 amps/in$^2$. Table I gives the parameters measured during the run.

The pH, measured as a 10 vol. % solution of the process stream in deionized water, was 5.90. Ninety nine point nine percent (99.9%) of the $EDTANa_4$ charged was recovered as EDTA. Sodium hydrdroxide (1,276.5 grams of 20.99 wt%) was recovered as the final catholyte.

TABLE I

| | Levels (cc) | | | Cell | | Flow Rates cc/min | | | |
|---|---|---|---|---|---|---|---|---|---|
| Example | $(NH_4)_2SO_4$ | V $Na^{+1}$ | NaOH | Volts | Amps | $(NH_4)_2SO_4$ | V $Na^{+1}$ | NaOH | Comments |
| 1 start | 1000 | 700 | 1150 | 5.15 | 9.0 | 410 | 270 | 420 | Start pH Versene = 12.56<br>pH anolyte = 5.16 |
| end 21 hours | 900 | 500 | 1300 | 5.44 | 9.0 | | | | pH Versene = 6.28<br>pH anolyte = 1.59 |
| 2 start | 1200 | 700 | 500 | 5.33 | 9.0 | 540 | 250 | 550 | pH Versene = 12.35<br>pH anolyte = 4.14 |
| end 21 hours | 950 | 800 | 700 | 4.66 | 9.0 | | | | pH Versene = 5.90<br>pH anolyte = 1.02 |

[1]V $Na^{+1}$ represents sodium EDTA

I claim:

1. A method for producing water insoluble organic acids from their water soluble salts, said salts produced under conditions wherein the ammonium salt thereof is not readily and efficiently produced during conventional production techniques or is incapable of being formed in a non-equilibrium cationic substitution reaction, which comprises electrochemically converting the water soluble salt of the water insoluble organic acid to its ammonium salt by feeding:

the ammonium salt of a strong inorganic acid to an anolyte chamber of a three chamber electrochemical cell;

a water soluble salt of a water insoluble organic acid to the middle chamber of said electrochemical cell; and, in the catholyte chamber of said cell, a hydroxide of the cation moiety of the organic acid salt; thereby electrochemically converting said organic acid salt to its ammonium salt, in the middle compartment, said strong inorganic acid to its free acid form in the anolyte chamber, and water to its hydroxyl and hydrogen components, in the catholyte chamber, the hydroxyl component reacting with the cation moiety of the water soluble salt of said organic acid fed to the middle compartment, and wherein, the ammonium salt of the organic acid and the inorganic acid produced in the anolyte chamber are recovered from the cell and reacted with each other to form the free acid of the organic ammonium salt and the ammonium salt of the strong inorganic acid; and, returning the ammonium salt of the strong inorganic acid to the anolyte chamber.

* * * * *